US005819325A

United States Patent [19]

Richards

[11] Patent Number: 5,819,325

[45] Date of Patent: Oct. 13, 1998

[54] TOILET SEAT LIFT

[76] Inventor: Edward L. Richards, P.O. Box 716, Cedar Grove, W. Va. 25039

[21] Appl. No.: 828,258

[22] Filed: Mar. 26, 1997

[51] Int. Cl.[6] ..... A47K 13/00

[52] U.S. Cl. ..... 4/237; 4/246.1

[58] Field of Search ..... 4/237, 246.1, 667, 4/246.2, 246.3, 246.5, 248

[56] References Cited

U.S. PATENT DOCUMENTS

| | | | |
|---|---|---|---|
| 5,027,446 | 7/1991 | Robertson | 4/254 |
| 5,063,617 | 11/1991 | Ward et al. | 4/251 |
| 5,309,583 | 5/1994 | White et al. | 4/667 |
| 5,312,157 | 5/1994 | Logan, Jr. | 297/250.1 |
| 5,588,162 | 12/1996 | Robinson | 4/667 |

*Primary Examiner*—David J. Walczak
*Attorney, Agent, or Firm*—Steptoe & Johnson

[57] ABSTRACT

A toilet seat lift, for use with a toilet seat and a toilet, for assisting a handicapped person in sitting down on and in rising up from a toilet seat. The toilet seat lift has a plurality of jacks connected to the toilet seat via hinges and to a motor. A handicapped person uses a control panel to engage the motor and jacks, thereby raising the toilet seat from a level position over the toilet to an upright position and to lower the toilet seat from the upright position to the level position. The present invention also comprises a frame structure with handrails that improve the stability and strength of the toilet seat lift. The frame structure is fixed to the floor surrounding the toilet and to the back wall. The handrails and jacks are attached to the frame structure and each handrail contains an embedded control panel. In an alterative embodiment, a person can use a foot control pad to control the raising and lowering of the toilet seat. Also, the toilet seat can be a concave ring, having a depression in the middle of the ring, thereby improving the security and stability of a person using the toilet seat lift.

17 Claims, 5 Drawing Sheets

TOILET SEAT LIFT

BACKGROUND OF THE INVENTION

1. Field of the Invention

This invention relates to toilets, and more specifically, to an apparatus and method for lifting a seat of a toilet to assist a person in sitting down on the toilet seat and in rising to a standing position from the toilet seat.

2. Related Art

For some people, especially the elderly or physically handicapped, sitting down or standing up is very difficult. As a result, handicapped people often require assistance when they sit down on a toilet seat or rise to a standing position from a toilet seat.

There are currently three methods available for assisting a handicapped person with sitting down on or rising up from a toilet seat. First, handrails, or grab bars, are often installed around the toilet to provide such persons with extra support. With the use of handrails, a handicapped person may be able to help himself on and off a toilet seat and maintain his privacy. The disadvantage with handrails, however, is that the handicapped person must be strong enough to pull himself up and support his own weight while maneuvering around the toilet. Handrails will not help the handicapped person who is too weak or incapacitated.

The second method for assisting a handicapped person with sitting down on or rising up from a toilet seat is the handicapped person receiving assistance from another person, such as an assistant. The assistant physically lifts or holds the handicapped person when putting him on or taking him off the toilet seat.

There are several disadvantages associated with a handicapped person having an assistant when using a toilet. First and most importantly, the handicapped person loses all privacy. It can be very embarrassing and awkward for a handicapped person to ask for and require an assistant to help him get on and off a toilet seat. Second, the assistant must be a very strong and capable person to be able to lift or hold the handicapped person as required. Third, the use of an assistant requires extra room around the toilet to provide two people room to maneuver. Although handicapped bathroom stalls are often larger than a conventional bathroom stall, such handicapped bathroom stalls may not always be available or may still not provide enough extra room on the sides of the toilet for two people to maneuver. Fourth, an assistant must be available to help a handicapped person. If an assistant is not available, the handicapped person must wait or seek help elsewhere, thereby potentially causing other problems.

The third method for assisting a handicapped person with sitting down on or rising up from a toilet seat comprises the use of a conventional mechanical device for lifting a toilet seat. These conventional devices, however, comprise complex structures requiring multiple motors and many mechanical components. Therefore, the installation and maintenance of these complex devices are very time consuming and require expert knowledge and numerous tools. Most importantly, these conventional devices are awkward for a handicapped person to use in both the manner of lift of a toilet seat and the controls thereof.

Therefore, there is a need for a toilet seat lift that can assist a person in sitting down on the toilet seat and in rising to a standing position from the toilet seat, such that the person does not need extra upper body strength or an assistant, but can operate the toilet seat lift quickly and efficiently. There is a further need for a toilet seat lift that can be installed easily and quickly on any existing toilet without requiring numerous tools, expert knowledge, or large delays.

SUMMARY OF THE INVENTION

The present invention solves the current problems associated with assisting a person in sitting down on and in rising to a standing position from a toilet seat. The present invention is a toilet seat to which a plurality of telescoping jacks, or hoists, are attached via hinges for the raising and lowering of the entire toilet seat. More specifically, the jacks raise a toilet seat completely off of the toilet itself to an upright position, and then the jacks lower the raised toilet seat back to a level position over the toilet. When in an upright position, the toilet seat is raised up off of the toilet and is pitched forward into a leaning position off of the vertical plane. Therefore, the toilet seat is raised both vertically and horizontally to meet a user.

A user controls the jacks with a single motor and a control panel having multiple control buttons. One control button engages the motor and jacks to raise the toilet seat. A second control button engages the motor and jacks to lower the toilet seat, and a third control button stops all movement of the motor and jacks, thereby stopping all movement of the toilet seat.

The present invention also comprises a frame structure that surrounds the toilet. The frame structure has a floor frame onto which the jacks are fixed, a plurality of vertical supports, a back frame, and a pair of handrails into which the control panel is embedded. The entire frame structure secures and stabilizes the jacks, and provides support to the user.

An advantage of the present invention is that a handicapped person does not have to lower himself from a standing position to a sitting position, or raise himself from a sitting position to a standing position. The present invention raises the toilet seat to meet the handicapped person. Therefore, once standing, the handicapped person simply has to lean against the raised toilet seat, and then lower the toilet seat, and himself, to the toilet. And in reverse, the present invention raises the handicapped person from a level position over the toilet to an upright position. Therefore, the handicapped person does not have to exert the energy or have the required strength to lift himself on and off the toilet.

Another advantage of the present invention is that a handicapped person who normally needs assistance from another person in sitting on and rising from a toilet seat can now be more independent. A handicapped person can either manage alone in the bathroom, or only require minimal assistance, thereby maintaining privacy and an increased sense of independence and dignity.

Another advantage of the present invention is that it is easily and efficiently installed on any conventional toilet once the conventional toilet seat is removed. When installing a toilet seat lift of the present invention, the frame structure slides around an existing conventional toilet. Then, the toilet seat of the present invention is placed on the toilet and the jacks are attached to the toilet seat and the floor frame and are connected to the motor, thereby easily converting the conventional toilet to a toilet with a toilet seat lift that accommodates handicapped persons. In contrast to available conventional toilet seat devices, the toilet seat lift of the present invention uses only one motor along with a plurality of hinges and telescopic hydraulic jacks to raise and lower a toilet seat.

In an alternative embodiment, the present invention provides a concave, or curved shaped, toilet seat that has a depression in the middle of the toilet seat similar to that of a saddle. When the concave toilet seat is raised to the upright position and a handicapped person leans against the concave toilet seat, the concave toilet seat securely holds the handicapped person in place before lowering him to the toilet. Further, the concave toilet seat securely holds the person when it is in the level position over the toilet. Another advantage of the concave toilet seat is that it supports a handicapped person when the concave toilet seat is in the upright position so the person can slowly and easily move off of, and on to, the concave toilet seat without requiring immediate support when being upright.

BRIEF DESCRIPTION OF THE FIGURES

The present invention is described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION OF THE PREFERRED EMBODIMENTS

Figure 1:
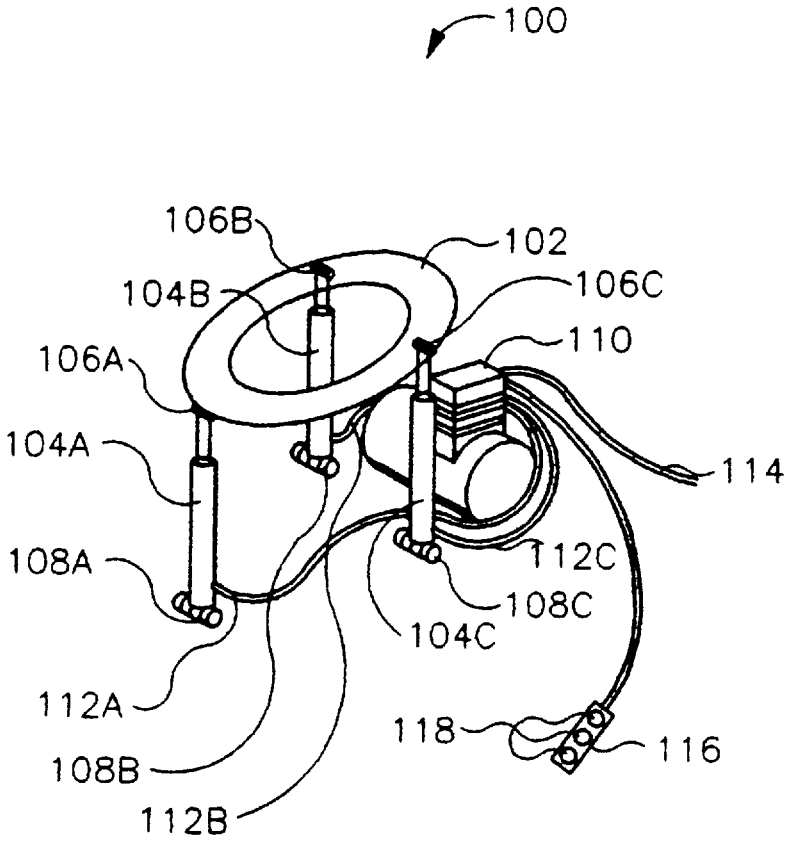
FIG. 1 is a perspective view illustrating the preferred embodiment of a toilet seat lift with a hand operated control panel.

The present invention is a toilet seat lift for raising a toilet seat from a level position over a toilet to an upright position off of the toilet. FIG. 1 is a perspective view illustrating the preferred embodiment of a toilet seat lift 100. The toilet seat lift 100 comprises a plurality of jacks 104*a*, 104*b*, 104*c* connected to a toilet seat 102 by top hinges 106*a*, 106*b*, 106*c*, such that one top hinge 106*a*, 106*b*, 106*c* connects one jack 104*a*, 104*b*, 104*c* to the toilet seat 102. The preferred embodiment of the toilet seat lift is shown in terms of three jacks 104*a*, 104*b*, 104*c*, one jack 104*a* located at the front of the toilet seat 102 and two jacks 104*b*, 104*c* located at the rear of the toilet seat 102, for convenience purposes only. It would be readily apparent to one skilled in the relevant arts to use a different number of jacks 104*a*, 104*b*, 104*c* to raise and lower the toilet seat 102, as well as to use brackets or comparable means to attach the jacks 104*a*, 104*b*, 104*c* to the toilet seat 102.

The jacks 104*a*, 104*b*, 104*c* are secured to the floor or a frame structure around a toilet with bottom hinges 108*a*, 108*b*, 108*c*, thereby providing stability to the toilet seat lift 100. A frame structure is described in greater detail below. In the preferred embodiment, the jacks 104*a*, 104*b*, 104*c* are telescopic air pumps that are extended and retracted by air pressure via lines 112*a*, 112*b*, 112*c*. It would be readily apparent, however, for one skilled in the relevant arts to use alternate jacks 104*a*, 104*b*, 104*c*, such as telescopic hydraulic pumps using hydraulic fluid or water in the lines 112*a*, 112*b*, 112*c*. Further, jacks 104*a*, 104*b*, 104*c* are well known in the relevant art and it would be readily apparent to one skilled in the art to select and use jacks 104*a*, 104*b*, 104*c* as described herein.

The jacks 104*a*, 104*b*, 104*c* are controlled by a single motor 110 and a hand operated control panel 116 having a plurality of control buttons 118. In the preferred embodiment, the motor 110 is an electric motor inside a protective housing and is connected to an electrical outline via an electric line 114.

Also in the preferred embodiment, the hand operated control panel 116 has three control buttons 118 for operating the motor 110 to move the jacks 104*a*, 104*b*, 104*c* up and down, and for stopping the motor 110 and jacks 104*a*, 104*b*, 104*c*. When the motor 110 is operational, a user of the toilet seat lift 100 presses the control buttons 118 on the hand operated control panel 116 to engage the motor 110 and jacks 104*a*, 104*b*, 104*c* and move the toilet seat 102 to an upright position off of the toilet, to a level position over the toilet, or to stop all movement. Specifically, when the user pushes the up control button 118, the motor engages the jacks 104*a*, 104*b*, 104*c* to extend from a retracted position to an extended position. When the jacks 104*a*, 104*b*, 104*c* are extended the toilet seat 102 is in an upright position. The down control button 118 is operated in the same manner such that when the down button is pressed, the motor 110 engages the jacks 104*a*, 104*b*, 104*c* to retract from the extended position to a vertical retracted position thereby the toilet seat 102 is level of the toilet.

The hand operated control panel 116 can either be a hand held control panel, or can be mounted in an easily accessible location, such as on a nearby wall or other fixture. Therefore, when a user wants to operate the toilet seat lift 100, he presses the control button 118 corresponding to the desired action. The preferred embodiment of the motor 110 and hand operated control panel 116 with control buttons 118 are described in these terms for convenience purpose only. It would be readily apparent for one skilled in the relevant arts to use a comparable motor 110, hand operated control panel 116 and control buttons 118.

Figure 2:
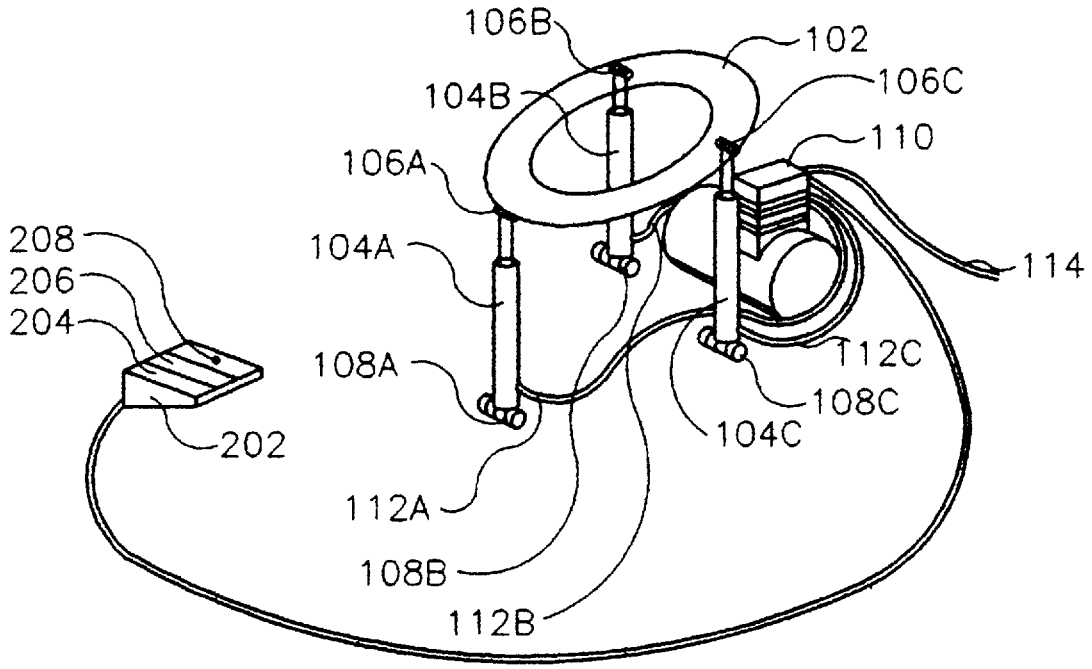
FIG. 2 is a perspective view illustrating the toilet seat lift with a foot operated control panel.

FIG. 2 is a perspective view illustrating an alternative embodiment of the present invention, wherein the jacks 104*a*, 104*b*, 104*c* are not controlled by a hand operated control panel 116, but rather are controlled by a foot operated control panel 202. The preferred embodiment of the foot operated control panel 202 has two pedals 204, 206 and one stop button 208. When the first pedal 204 is pressed, the motor 110 engages the jacks 104*a*, 104*b*, 104*c* to extend to the up position, thereby raising the toilet seat 102 off of a toilet. When the second pedal 206 is pressed, the motor 110 engages the jacks 104*a*, 104*b*, 104*c* to retract to a down position, thereby lowering the toilet seat 102 to a level position over a toilet. The stop button 208 can be pressed at any time and is used to stop all movement of the motor 110 and the jacks 104*a*, 104*b*, 101*c*, thereby stopping all movement of the toilet seat 102. The foot operated control panel 202 is described in these terms for convenience purpose only. It would be readily apparent to one skilled in the relevant arts to develop an alternate foot operated control panel 202 with a different configuration of pedals 204, 206 and a button 208 for controlling the position of the toilet seat 102.

Figure 3:
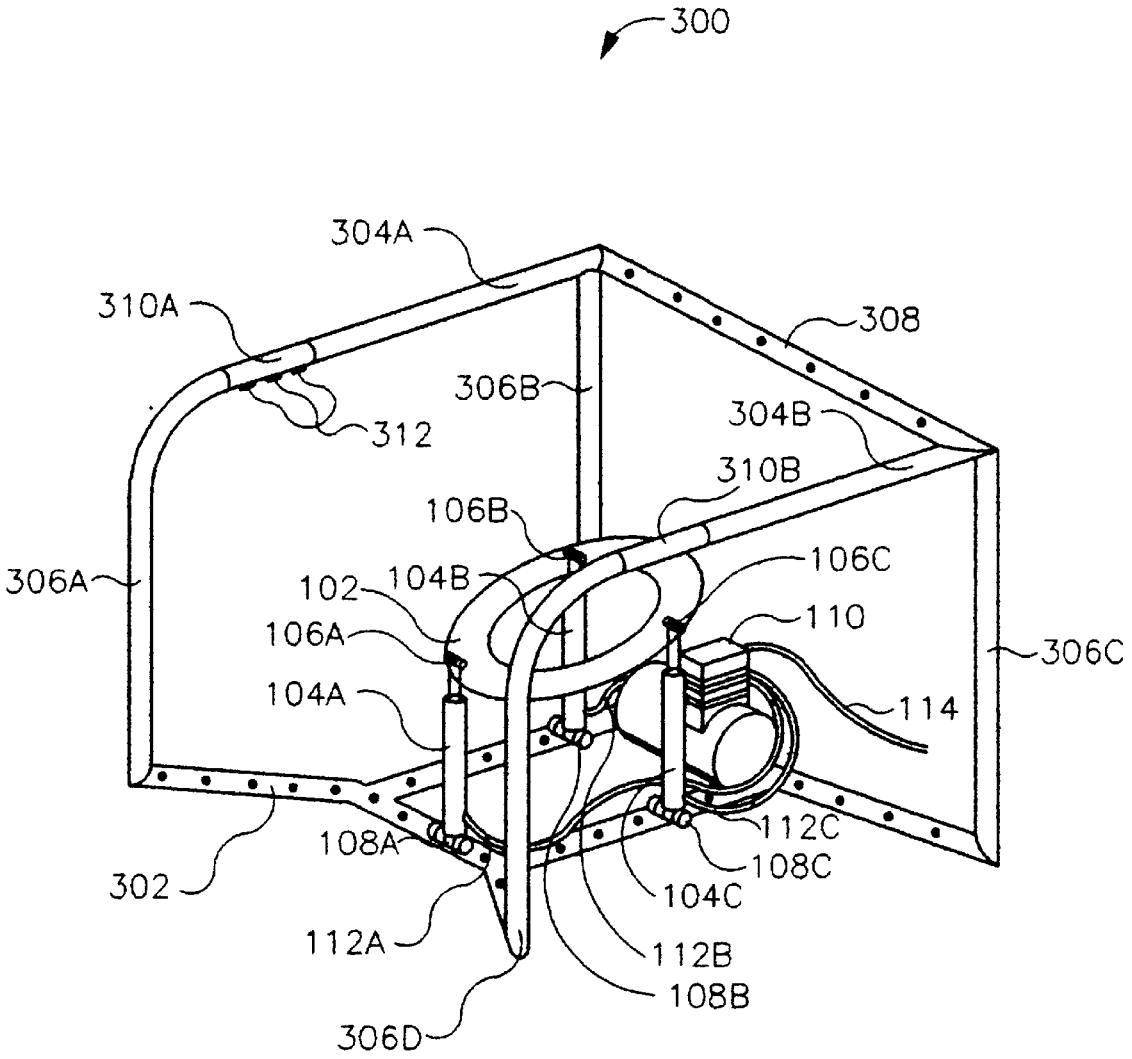
FIG. 3 is a perspective view illustrating the toilet seat lift incorporating the preferred embodiment of a frame structure.

FIG. 3 is a perspective view illustrating the toilet seat lift 100 incorporating the preferred embodiment of a frame structure 300. The frame structure 300 comprises a floor frame 302, four vertical supports 306*a*, 306*b*, 306*c*, 306*d*, two handrails 304*a*, 304*b*, and a back support 308. The floor frame 302 is fixed to the floor area surrounding a toilet by means known in the relevant art, such as, bolts, adhesive, nails, or any comparable means as appropriate. The jacks 104*a*, 104*b*, 104*c* connect the toilet seat 102 to the floor frame 302, thereby securing the jacks 104*a*, 104*b*, 104*c* so they do not slide or slip out of alignment. More specifically, the jacks 104*a*, 104*b*, 104*c* are connected to the toilet seat 102 via top hinges 106*a*, 106*b*, 106*c*, and are connected to the floor frame 302 with bottom hinges 108*a*, 108*b*, 108*c*. The lines 112*a*, 112*b*, 112*c* connecting the jacks 104*a*, 104*b*, 104*c* to the motor 110 run alongside the floor frame 302, as shown, or run under the floor frame 302 or under a protective housing.

Four vertical supports 306*a*, 306*b*, 306*c*, 306*d* connect the floor frame 302 with the handrails 304*a*, 304*b* and the back support 308. The back support 308 is securely attached to the back wall behind the toilet to provide extra stability to the handrails 304*a*, 304*b* and frame structure 300. The back support 308 is attached by means known in the relevant art, such as bolts, adhesive, nails, or any other comparable means as appropriate. The frame structure 300 is described in terms of four vertical supports 306*a*, 306*b*, 306*c*, 306*d* for convenience purposes only. It would be readily apparent to one skilled in the relevant arts to construct a frame structure 300 with a different number of vertical supports 306*a*, 306*b*, 306*c*, 306*d*.

In the preferred embodiment, the jacks 104*a*, 104*b*, 104*c* are attached to the frame structure 300 to improve stability and strength to the toilet seat lift 100. The frame structure 300 is made from lightweight steel for strength and durability. It would be readily apparent, however, for the frame structure 300 to be made out of aluminum, heavy plastic, or other comparable material.

In this preferred embodiment, the hand operated control panel 116, as shown in FIG. 1, is incorporated into the handrails 304*a*, 304*b* such that each handrail 304*a*, 304*b* has an embedded control panel 310*a*, 310*b*. Each embedded control panel 310*a*, 310*b* has control buttons 312 for raising the toilet seat 102, lowering the toilet seat 102, and stopping all movement. It would be readily apparent, however, for a person skilled in the relevant arts to place the hand operated control panel 116 or embedded control panels 310*a*, 310*b* in a different location on the frame structure 300.

Therefore, the entire frame structure 300 and the toilet seat lift 100 as described provide a standing, fully secured apparatus for assisting a person with sitting down on and rising up from a toilet seat 102, that is easily and quickly installed and maintained around any existing conventional toilet.

Figure 4:
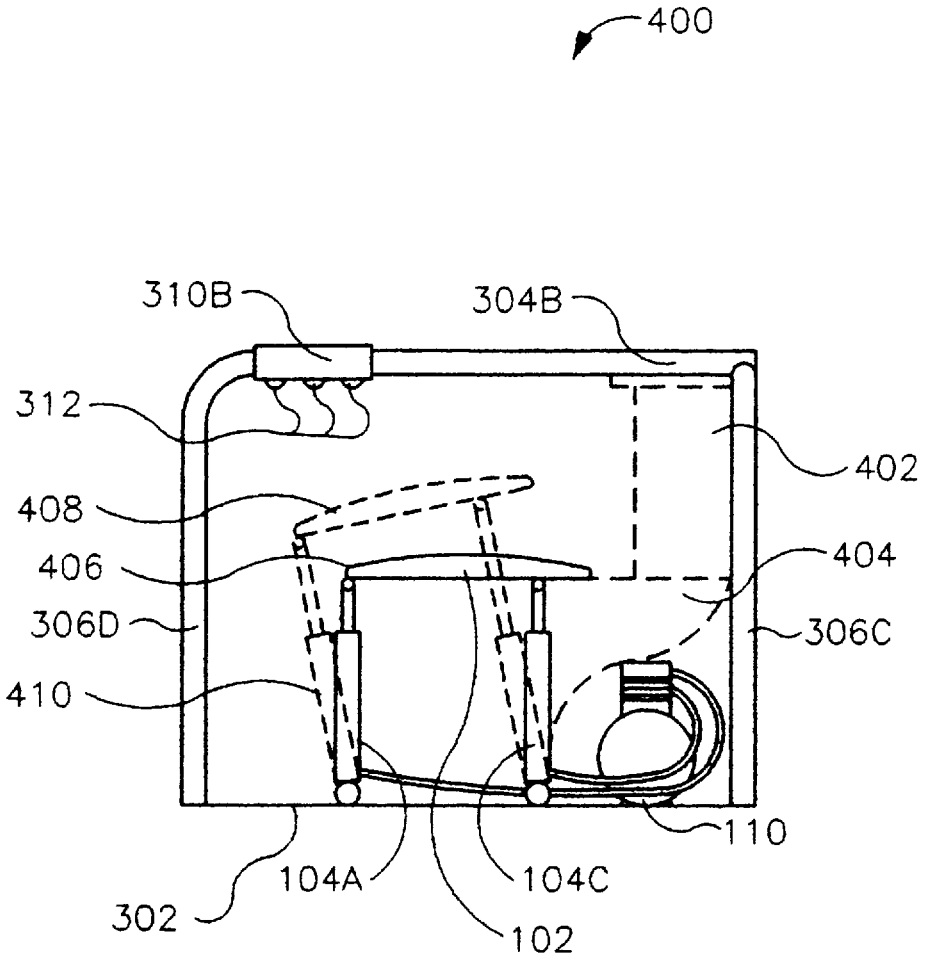
FIG. 4 is a side elelvational view illustrating the operation of the toilet seat lift.

FIG. 4 is a perspective view illustrating the operation of the preferred embodiment of the toilet seat lift 100 with the frame structure 300. For convenience purpose only, the toilet seat lift 100 and the frame structure 300 are shown from a side view. Further, the toilet seat lift 100 and frame structure 300 are shown how they would operate over and around a conventional toilet 404 and toilet water tank 402.

When a handicapped person wants to use the toilet seat lift 100, he uses the appropriate control button 312 on a handrail 304*a*, 304*b* to engage the motor 110 and jacks 104*a*, 104*b*, 104*c* to raise the toilet seat 102 from a level position 406 over the toilet 404 to an upright position 408. When in the upright position 408, the toilet seat 102 is raised up off of the toilet 404 and is pitched forward into a leaning position 410 off of the vertical plane. Therefore, the toilet seat 102 is raised both vertically and horizontally to meet the user. The person then maneuvers himself, or receives minimum assistance, to lean against the toilet seat 102 in the upright position 408.

When properly situated on the toilet seat 102, the person then uses the appropriate control button 312 on a handrail 304*a*, 304*b* to engage the motor 110 and jacks 104*a*, 104*b*, 104*c* to lower the toilet seat 102, and himself, to the level position 406 over the toilet 404. When he is ready, the person then uses the control buttons 312 to raise himself back to the upright position 408, at which point he gets off of the toilet seat 102. At any time during the operation of the toilet seat lift 100, the person can use the appropriate control button 312 to stop all movement of the motor 110 and jacks 104*a*, 104*b*, 104*c*, thereby stopping all movement of the toilet seat 102.

As shown in FIG. 4, the jacks 104*a*, 104*c* are extended when the toilet seat 102 is in the upright position 408, and they are retracted when the toilet seat 102 is in the level position 406. Further, when the toilet seat 102 is in the upright position 408, the top hinges 106*a*, 106*b*, 106*c* and bottom hinges 108*a*, 108*b*, 108*c* move such that the jacks 104*a*, 104*b*, 104*c* pivot, or swing, forward off of the vertical plane into the leaning position 410. Also, as shown in FIG. 4, when the toilet seat 102 is in the upright position 408, the jacks 104*c* located at the rear of the toilet seat 102 extend farther then the single jack 104*a* located at the front of the toilet seat 102, thereby providing the necessary forward pitch required for optimal use of the present invention. Also as shown, when the toilet seat 102 is in the level position 406 over the toilet 404, the jacks 104*a*, 104*b*, 104*c* are retracted in a vertical position. It would be readily apparent to one skilled in the relevant arts to manufacture and assemble the necessary jacks 104*a*, 104*b*, 101*c*, motor 110, and embedded control panels 310*a*, 310*b* to perform the operations described herein.

In the preferred embodiment of the present invention, the motor 110 is placed under the toilet 404 and toilet water tank 402 in order to remove the motor 110 from being in the way of the person using the toilet 404. In an alternate embodiment, the motor 110 can be placed in any convenient location such as to the side of the toilet 404 or above the toilet 404.

For structural purposes, the periphery of the toilet seat 102 of the preferred embodiment of the present invention extends beyond the rim of the bowl of the toilet 404. In one embodiment, the periphery of the toilet seat 102 extends approximately two inches beyond the rim. This extended periphery provides the top hinges 106*a*, 106*b*, 106*c* and jacks 104*a*, 104*b*, 104*c* room to connect to the toilet seat 102 and to operate. Further the extended periphery of the toilet seat 102 allows the top hinges 106*a*, 106*b*, 106*c* and jacks 104*a*, 104*b*, 104*c* to generate the leverage needed to raise and lower the toilet seat 102. It would be readily apparent, however, for a person skilled in the relevant art to construct a toilet seat 102 with a different size periphery that achieves the same operational results.

Figure 5:
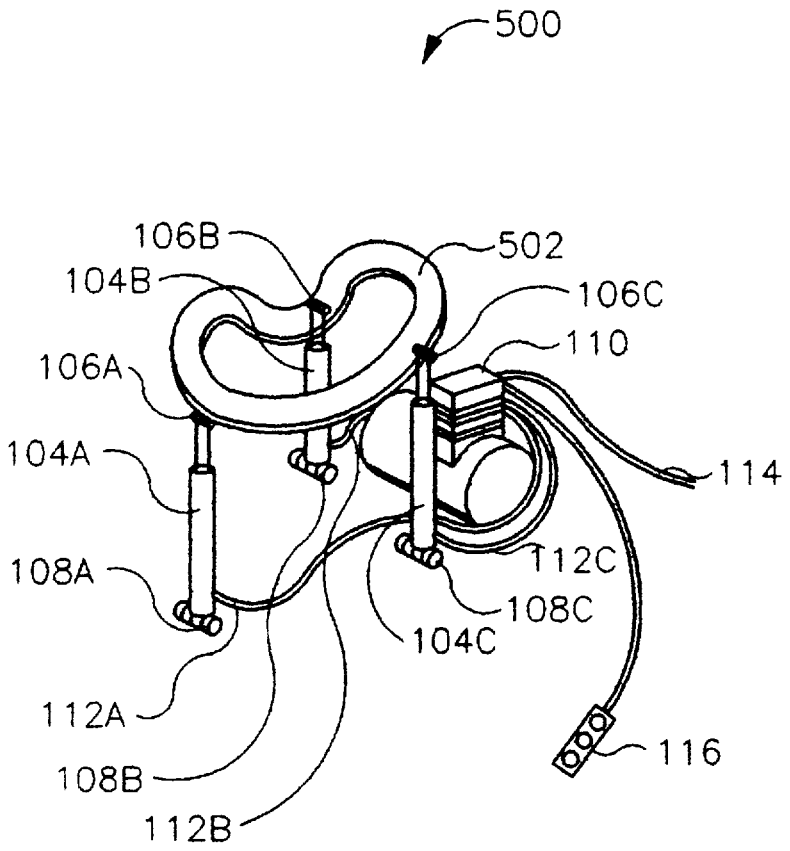
FIG. 5 is a perspective view illustrating an alternative embodiment of a concave toilet seat.

FIG. 5 is a perspective view illustrating an alternative embodiment of a concave toilet seat 502. In this embodiment, the concave toilet seat 502 is a concave ring that has a depression in the middle of the ring, thereby securely holding a person on the concave toilet seat 502, especially when the concave toilet seat 502 is in the upright position 408. The concave toilet seat 502 can be used with the toilet seat lift 100 and frame structure 300 described above.

CONCLUSION

While various embodiments of the present invention have been described above, it should be understood that they have been presented by the way of example only, and not limitation. It will be understood by those skilled in the art that various changes in form and details may be made therein without departing from the spirit and scope of the invention as defined in the appended claims. Thus, the breadth and scope of the present invention should not be limited by any of the above-described exemplary embodiments, but should be defined in accordance with the following claims and their equivalents.

What is claimed is:

1. A toilet seat lift, for use with a toilet, comprising:

a toilet seat having a front, a first side, a second side, and a rear;

a floor frame attached to a floor under the toilet;

three jacks, wherein one said jack is attached to the front of said toilet seat, one said jack is attached to the first side of the toilet seat toward the rear of the toilet seat, and one said jack is attached to the second side of the toilet seat toward the rear of the toilet seat;

three top hinges, wherein each said top hinge attaches one said jack to said toilet seat, thereby allowing said toilet seat to rotate to a forward upright position when raised and to rotate to a level position over the toilet when lowered;

three bottom hinges, wherein each said bottom hinge attaches one said jack to said floor frame;

a motor, connected to said three jacks; and a control panel, connected to said motor, for controlling the operation of said motor and said three jacks to raise and lower said toilet seat.

2. The toilet seat lift of claim 1, further comprising:

a plurality of vertical supports attached to said floor frame; and one or more handrails, wherein said handrails are connected to said vertical supports.

3. The toilet seat lift of claim 2, further comprising:

a back support, connected to said vertical supports and said handrails, wherein said back support is attached to a wall behind the toilet.

4. The toilet seat lift of claim 2, wherein one or more of said handrails has said control panel embedded within it.

5. The toilet seat lift of claim 1, wherein said control panel comprises:

a means for engaging said motor to extend said three jacks to raise said toilet seat off of the toilet to a forward upright position;

a means for engaging said motor to retract said three jacks to lower said toilet seat from said forward upright position to a level position over the toilet; and a means for stopping movement of said three jacks, thereby stopping movement of said toilet seat.

6. The toilet seat lift of claim 1, wherein said control panel is a hand operated control panel.

7. The toilet seat lift of claim 1, wherein said control panel is a foot operated control panel.

8. The toilet seat of claim 1, wherein said three jacks are hydraulic jacks.

9. The toilet seat of claim 1, wherein said three jacks are air pumps.

10. The toilet seat lift of claim 1, wherein a periphery of said toilet seat extends beyond a rim of the toilet.

11. The toilet seat lift of claim 1, wherein said toilet seat is a concave ring, having a depression in the middle of said concave ring.

12. A toilet seat lift, for use with a toilet, comprising:

a toilet seat having a front, a first side, a second side, and a rear;

a frame structure, having a floor frame attached to a floor under the toilet, a plurality of vertical supports attached to said floor frame, one or more handrails connected to said vertical supports, and a back support connected to said handrails and said vertical supports and attached to a wall behind the toilet;

three jacks, wherein one said jack is attached to the front of said toilet seat, one said jack is attached to the first side of the toilet seat toward the rear of the toilet seat, and one said jack is attached to the second side of the toilet seat toward the rear of the toilet seat;

three top hinges, wherein each said top hinge attaches one said jack to said toilet seat, thereby allowing said toilet seat to rotate to a forward upright position when raised and to rotate to a level position over the toilet when lowered;

three bottom hinges, wherein each said bottom hinge attaches one said jack to said floor frame;

a motor, connected to said three jacks; and a control panel, connected to said motor, for controlling the operation of said motor and said three jacks to raise and lower said toilet seat.

13. The toilet seat lift of claim 12, wherein said toilet seat is a concave ring, having a depression in the middle of said concave ring.

14. The toilet seat lift of claim 12, wherein said jacks are hydraulic jacks.

15. The toilet seat lift of claim 12, wherein said jacks are air pumps.

16. The toilet seat lift of claim 12, wherein said control panel is a foot operated control panel.

17. The toilet seat lift of claim 12, wherein said control panel is embedded in one or more said handrails.

* * * * *